United States Patent [19]

Schuman

[11] Patent Number: 4,467,971

[45] Date of Patent: Aug. 28, 1984

[54] GYRATORY CONE CRUSHER

[75] Inventor: LeRoy Schuman, Milwaukee, Wis.

[73] Assignee: Lippmann-Milwaukee, Inc., Milwaukee, Wis.

[21] Appl. No.: 310,059

[22] Filed: Oct. 9, 1981

Related U.S. Application Data

[62] Division of Ser. No. 120,708, Feb. 11, 1981.

[51] Int. Cl.[3] ..... B02C 2/04

[52] U.S. Cl. ..... 241/215

[58] Field of Search ..... 241/207–216

[56] References Cited

U.S. PATENT DOCUMENTS 3,887,143 6/1975 Gilbert et al. ..... 241/215

*Primary Examiner*—Mark Rosenbaum

*Attorney, Agent, or Firm*—Ronald E. Barry

[57] ABSTRACT

A gyratory cone crusher of the type having a crusher head assembly mounted on an intermediate member supported for rotary motion on a shaft to produce gyratory motion of the crusher head assembly within a bowl assembly. The intermediate member including a skirt surrounding the shaft and a stub shaft of reduced diameter extending upward above the shaft. The intermediate member being supported on the shaft and the crusher head assembly being supported on the intermediate member by roller bearing assemblies, the bearing assemblies being lubricated by a closed lube oil recirculating system, and an anti-spin assembly connected between the spindle and the crusher head assembly, the anti-spin assembly being self-aligning with respect to the crusher head assembly, and including a one-way clutch either of the linkage or cam type mounted in the spindle.

20 Claims, 3 Drawing Figures

149
147
151
151
153
153
148
144
130
128
16
131
125
26
122
120
124
111
127
117
144
126
98
150
146
116
3
129
3
148
147
155
158
149
145
114
151
157
153
152
176
154
166
176
170
29
77
29
106
174
173
169
104
171
172
138
140
90
156
98
94
28
70
76
134
164
143
78
102
178
160
80
18
162
20
30
157
142
110
84
174
66
62
27
141
136
138
165
81
60
139
137
140
92
22
64
68
14
108
96
56
74

GYRATORY CONE CRUSHER

PRIOR APPLICATION

This is a division of my earlier filed application Ser. No. 120,708, filed on Feb. 11, 1981.

BACKGROUND OF THE INVENTION

Gyratory cone crushers generally include cylinder or sleeve bearings located between the eccentric shaft and the main frame as well as between the crusher head assembly and the eccentric shaft. These bearing assemblies are arranged in a floating arrangement wherein the dead weight alone of the rotating components holds the assembly together. This principal has been rigorously followed by manufacturers of both anti-friction and sleeve bearing machies mainly for ease of assembly and field repairs. Generally, these designs have been subject to bearing wear problems on the corners of the rollers caused by the constantly rotating eccentrically located crushing force. This eccentric loading introduces an overturning moment on the crusher head assembly, which in turn places a moment load upon the radial bearing within the crusher head assembly. This bearing moment in turn induces a moment into the lower radial bearing between the main frame and the eccentric shaft.

SUMMARY OF THE INVENTION

The gyratory cone crusher of the present invention incorporates the floating bearing arrangement concept into the design, but accomplishes this concept by the use of tapered roller bearings only. The tapered roller bearings are so arranged that they can be lubricated through a closed recycling lubricating oil system provided within the cone crusher. The floating head assembly is supported on two different diameter tapered roller bearings with a smaller upper bearing assembly and a much larger diameter lower bearing assembly. The lower bearing assembly acting as both a thrust and a radial bearing while the upper bearing acts primarily as a radial bearing. The bearing arrangement between the main frame and spindle and the eccentric member also includes two different diameter tapered roller bearings, both of which are primarily radial load bearings. A third thrust bearing is provided between the spindle and the eccentric member to relieve thrust on the radial bearings.

An anti-spin mechanism is provided between the spindle and the crusher head assembly which includes a one way clutch that is attached directly to the spindle and to a key socket in the crusher head assembly by a hexagonal shaped brake shaft. This shaft includes hexagonally shaped balls at each end which engage corresponding hexagonal sockets in the over running clutch and the keyed socket. The keyed socket being displaceable in the crusher head assembly to allow the automatic seating of the brake shaft in the keyed socket on assembly. The anti-spin mechanism is immersed in the pressurized side of the circulating lubricating oil system.

DRAWINGS

DESCRIPTION

Figure 1:
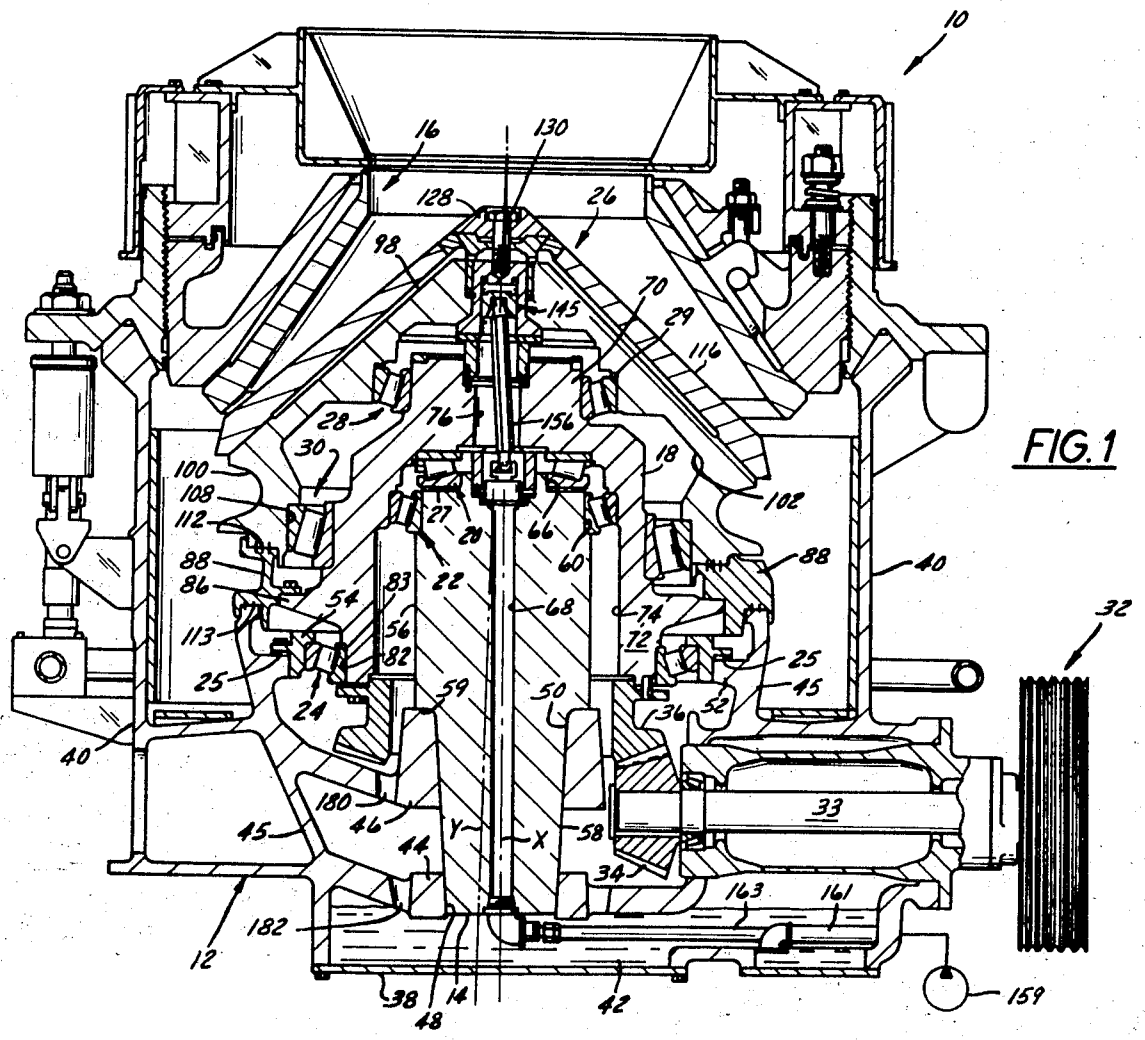
FIG. 1 is a cross sectional elevation view of the cone crusher according to the present invention.

The gyratory cone crusher 10 according to the present invention generally includes a main frame 12 for supporting a spindle 14 and a bowl 16. An eccentric member or shaft 18 is supported by means of a number of tapered roller bearing assemblies 20, 22, 24 for eccentric rotation about the offset axis "Y". A crusher head assembly 26 is supported on eccentric member 18 by means of tapered roller bearing assemblies 28, 30 for gyratory movement with respect to bowl assembly 16. Means are provided for rotating the eccentric member 18 in the form of drive assembly 32 mounted in the main frame 12. In this regard, the drive assembly 32 includes a shaft 33 mounted for rotary motion in the main frame and a bevel gear 34 mounted on the shaft that cooperates with a ring gear 36 provided on the lower end of the eccentric member 18. The shaft can be driven by any power source to impart rotary motion to the eccentric member 18 and gyratory motion to the crusher head assembly 26.

In accordance with one aspect of the invention, the bearing assemblies between the eccentric member 18 and main frame 13, as well as between the crusher head assembly 26 and the eccentric member 18, are so arranged that the dead weight of the rotating components, eccentric member and crusher head assembly holds the bearing assemblies together. More particularly, and referring to the bearing assemblies between the crusher head assembly 26 and the eccentric member 18, a floating arrangement is utilized which includes two different diameter tapered roller bearings, i.e., a smaller bearing for the upper bearing assembly 28 and a much larger bearing for the lower bearing assembly 30. The lower bearing assembly 30 acts as both a thrust and a radial bearing while the upper bearing assembly 28 acts as a radial bearing only. In this regard, it should be noted that shims 29 are provided between the head assembly 26 and the bearing assembly 28 so that only the radially induced thrust force acts on the bearing assembly 28 even though the bearing assembly acts primarily as a radial bearing. Shims are selected to maintain an 0.002 to 0.003 diametral clearance. It should be noted that the raceways for the bearing assemblies 28 and 30 are concentric to the offset axis "Y" of the eccentric member 18.

The floating bearing arrangement between the spindle 14 and the eccentric member 18 also includes two different diameter tapered radial roller bearings, i.e., a smaller upper bearing assembly 22 and a larger lower bearing assembly 24. Shims 25 are provided under bearing carrier ring 54 to reduce or eliminate external thrurst forces on bearing assembly 24. The thrust forces between the eccentric member 18 and spindle 14 is carried by the V-flat upper bearing assembly 20 to relieve thrust forces on bearing assembly 22. The two radial load bearing assemblies 22, 24 are clamped up or locked together in order to eliminate any residual moments in the bearing asemblies without causing a noticeable change in slope. It should be noted that raceways for the bearing assemblies 22 and 24 are concentric to the axis "Y" that is oblique to the "X" axis and the extended axes of the tapered bearings in these assemblies meet at an apex.

Referring more particularly to FIG. 1 of the drawing, the main frame 12 generally includes a bottom or base 38 and cylindrical side walls 40 extending upwardly from the base 38. The base and side walls defining a lubricating oil sump 42 at the bottom of the main frame 12. A pair of annular spindle support members 44, 46 are provided on the inside of an inner support wall 45 provided on the interior of the frame, each support member including a central opening, 48, 50 respectively. A radially inwardly directed flange 52 is provided on the inner support wall for supporting a bearing carrier ring 54 as more particularly described hereinafter.

The spindle 14 generally includes a main section 56 and a lower conical section 58 which termintes at a shoulder 59. The main section 56 is provided with a machined surface 60 around the upper portion of the main section and a flat machined ring 62 around the top of the main section. The machined surface 60 terminating at a radial shoulder 64 and the flat machined surface 62 terminating at an axial shoulder 66. A central bore 68 is provided through the center of the spindle. The spindle is mounted in the main frame by seating the lower conical section 58 in the corresponding openings 48, 50 in the spindle support 44 and 46, respectively.

The eccentric member 18 includes an upper section 70 and lower annular skirt or flange 72 which defines a spindle cavity 74. A bore 76 is provided through the center of the upper section 70 which terminates at a first machined surface 78 on the inner surface of the upper section. A second machined surface 80 is provided at the inner end of the cavity 74 which forms the upper bearing surface for bearing asembly 20. A machined surface 81 is provided around the upper inner portion of skirt 72 which in cooperation with surface 60 support bearing assembly 22. A machined surface 82 is provided around the outer surface of the skirt 72 which terminates at a shoulder 83 and acts along with carrier ring 54 to support bearing assembly 24. A radially extending flange 86 is also provided around the outer surface of the skirt 72 to support a seal ring 88 as described hereinafter. Machined surfaces 90, 92 are provided around the upper section 70 and the skirt 72, respectively, which terminate at shoulders 94 and 96, respectively.

The eccentric member 18 is mounted on the bearing assemblies 20, 22 and 24 to rotate about the axis "X" of the spindle 14 but, as seen in the drawing, the member 18 is eccentric to the axis of the spindle to impart the gyratory motion to the head 26. It should be noted that the bearing assemblies 20 and 22 are free floating in that the eccentric member 18 can be lifted directly off the spindle 14 after the bearing carrier ring has been removed. If a straight radial bearing assembly is used for the tapered bearing assembly 24, the eccentric member 18 can then be lifted directly off all three bearing assemblies.

The crusher head assembly 26 generally includes a taper head 98 of generally conical configuration having a depending flange 100 defining a cavity 102 within the head assembly. A first machined bore 104 is provided on the inner portion of the cavity 103 and terminates at a shoulder 106. The bearing assembly 28 is seated between machined surfaces 90 and 104. A second machined surface 108 is provided at the open end of the flange 100 and terminates at a shoulder 110. The bearing assembly 30 is seated between machined surfaces 92 and 108.

The crusher head assembly 26 is supported by bearing assemblies 28 and 30 to rotate on an axis "Y" that is oblique to the spindle axis "X". It should also be noted that the bearing assemblies 28 and 30 are free floating in that the crusher head assembly 26 can be lifted directly off the eccentric member 18. Means are provided on the lower edge of the flange 100 and upper edge of support wall 45 to sealingly engage the seal ring 88. Such means is in the form of labryinth seals 112 and 113, respectively. A bore 114 is provided in the center of the taper head 98.

Means are provided on the outer surface of the taper head 98 for crushing rock in cooperation with the bowl assembly 16. Such means is in the form of a mantle or cone 116 made of work hardening or manganese steel positioned on the outer surface of the head 98. An opening 117 is provided at the apex of the cone 116. The cone 116 is held in position on the taper head 98 by means of a mantle nut 122.

In this regard, the mantle nut 122 bears against a burning ring 120 positioned in alignment with the opening 117 in the cone 116. The mantle nut 122 includes a center opening 111. A conical camming flange 124 is provided on the mantle nut 122 which engages the upper edge 125 of the ring 120 to center and cam the ring 120 into engagement with the upper edge 127 of the cone 116. A central bore 126 is provided in the center of the mantle nut 122 which has an internal threaded section 129. The upper end of the head assembly 26 is closed by means of a mantle cap 128 having a central opening 131. The mantle cap 128 is centered on the mantle nut 122 and held thereon by a bolt 130 which passes through opening 131.

With regard to this last description, means are provided in the opening 114 in support member 98 for engaging the bolt 130. Such means is in the form of a plug or cap 144 having a threaded bore 146, a blind bore 148 and a threaded section 150 around the outer upper end of the plug. A conical radial flange 152 is provided around the lower outer periphery to engage a corresponding surface 154. The plug 144 is screwed into the threaded section 129 of nut 122 until flange 152 is seated against conical surface 154. The bolt 130 is screwed into the threaded bore 146 to hold the mantle cap 128 in place.

Figures 2, 3:
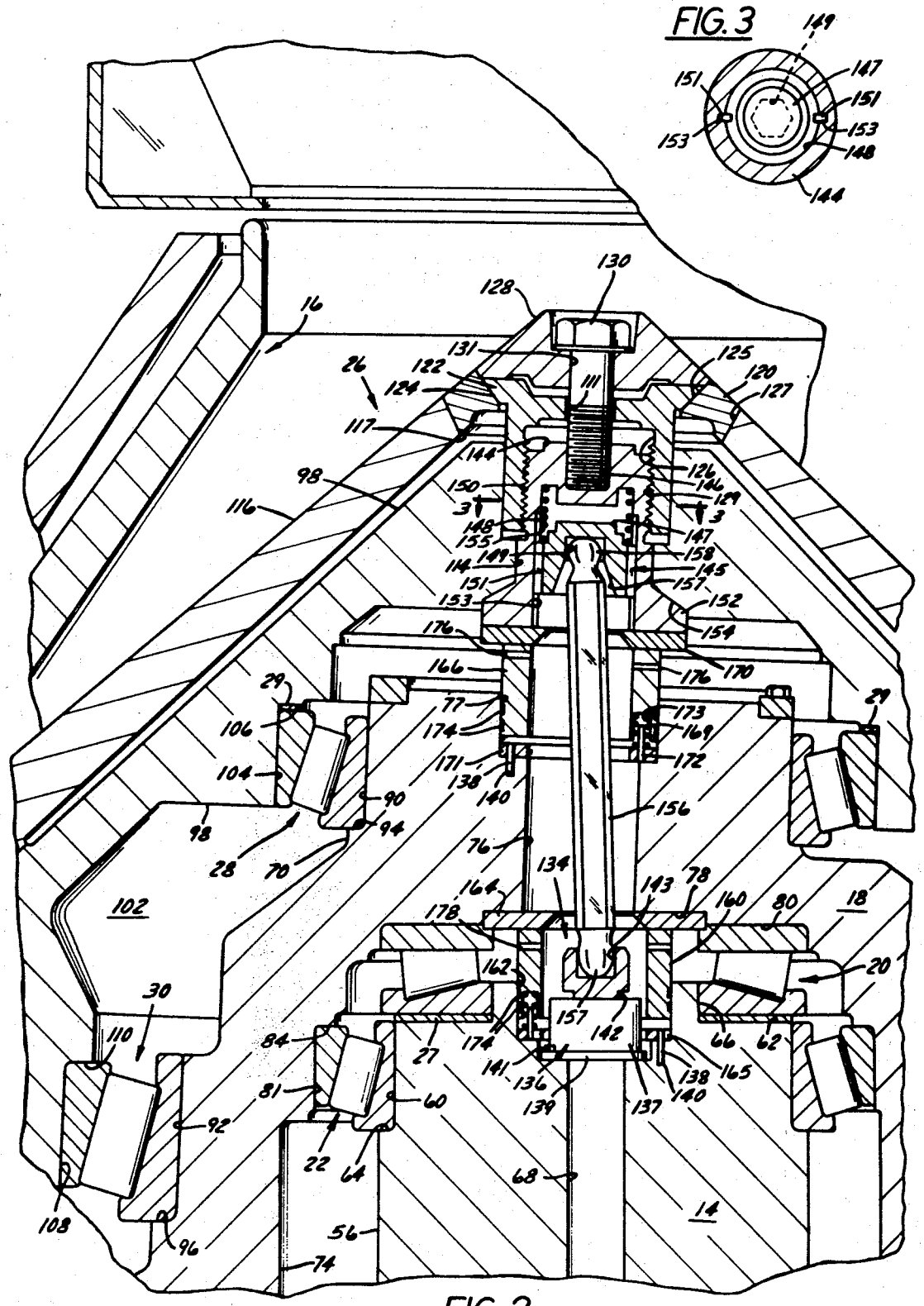
FIG. 2 is an enlarged cross sectional view of the anti-spin mechanism and lube oil system.
FIG. 3 is a view taken on line A—A of FIG. 2 showing the keyed socket member.

The crusher head assembly 26 is restrained from rotation with respect to the eccentric member 18 by means of an anti-spin mechanism 134 provided between the spindle 14 and the head assembly 26. As seen in FIG. 2, the anti-spin mechanism includes an overrunning clutch or brake 136, a brake shaft 156 and a brake shaft lock assembly 145. The clutch or brake 136 is a roller ramp type one way clutch using a cam system to limit rotation only in a direction opposite to the direction of rotation of the eccentric member 18. The overrunning clutch 136 includes a housing 137 and a keyed member 142 having a hexagonal recess 143 which extends upward from the housing 136. The housing 136 includes a slotted flange 139 which is secured to the spindle 14 by means of bolts 141. A spring set brake may be used in conjunction with the one way clutch if necessary.

The lock assembly 145 is positioned within the blind bore 148 of plug 144. A socket member 147 having a hexagonal recess 149 is provided within the blind bore 148 in the plug 144. The member 147 is movable axially within the recess but is restrained from rotation by keys 151 which are aligned with slots 153 to prevent rotary movement. The keyed socket member 147 is biased outwardly from the blind bore by means of a spring 155. A conical guide opening 157 is provided at the open end of recess 149.

The lock assembly 145 is connected to the overrunning clutch 136 by means of the hexagonally shaped shaft 156 which has hexagonally shaped balls 157 and 158 at the ends. The ball 157 is seated in the recess in the keyed member 142 in the overrunning clutch and the ball 158 is seated in the hexagonal socket 149 provided in the member 147.

The anti-spin mechanism 134 and the tapered bearings 20, 22, 24, 28, 30 are lubricated by means of a pressurized oil system provided within the cone crusher 10. Such means is the form of a closed oil flow circuit which includes the sump 42, an oil pump 159 and an oil flow path which in sequence includes the bore 68 in the spindle 14, the bore 76 in the eccentric member 18 and a gravity return feed flow path through the bearing assemblies back to the sump 42.

As seen in the drawings, a lube oil pipe 161 connects the sump 42 to the pump 159. A second lube oil pipe 163 connects the pump 159 to the lower end of the bore 68 in the spindle 14. Means are provided for connecting the upper end of the bore 68 to the bore 76 in the eccentric member 18. Such means is in the form of cylindrical member 160 which is positioned in an enlarged bore 162 provided at the end of the bore 68. A bronze seal washer 164 is provided at the surface 78 of the member 18 and is seated flush against the upper surface of the cylindrical member 160 to seal the space between the member 160 and the surface of the seal washer 164.

A second means is provided to connect the bore 76 to the blind bore 148 in the plug 144. Such means is in the form of a second cylinder 166 which is positioned within an enlarged bore 77 provided at the upper end of the bore 76. A second bronze seal washer 170 is provided at the lower surface of the plug 144 and is seated flush with the upper surface of the cylindrical member 166 to seal the space between the cylindrical member 166 and the plug 144. The washer 170 also retains the socket member 147 in the recess 148. Means are provided to seal the cylinders 160 and 166 in the bores 162, 77. Such means is in the form of a number of o-ring seals 174 provided on the outer portion of the cylinders 160, 166.

The cylindrical members 160, 166 are biased into engagement with the seal washers 164 and 170, respectively, by means of springs 169 in order to maintain the seal with the seal washers. More particularly, locating washers 165 and 171 are positioned within the bores 162 and 77, respectively. The locating washers are located therein by means of pins 138 provided on the washers 165 and 171. The pins 138 are aligned in holes 140 provided at the bottom of the bores 162 and 77. The springs 169 are mounted on pins 172 which are secured to washers 165 and 171. The pins 172 and springs 169 are aligned with a number of blind holes 173 provided in the bottom of cylindrical members 160 and 166.

Oil pumped through the fluid flow path provided by passage 68 will fill the reservoir formed by the cylindrical members 160, 166 and the bore 76 in the eccentric member 18. Oil from the reservoir flows to the bearing assemblies 18, 30, 24 through metering orifices 176 provided in the cylindrical member 166 and to the bearing assemblies 20, 22 through metering orifices 178 provided in the cylindrical member 160. It should be noted that the anti-spin mechanism 134 is immersed in the lubricating oil within the reservoir and is therefore self-lubricating. The oil as it flows through the bearing assemblies is confined within the inner support wall 45 by means of the seal ring 88. The oil returns to the sump 42 through openings 180 and 182 in the frame.

In order to allow for sufficient flexibility in assembly, the brake shaft 156 is automatically aligned in the socket 149 provided in the socket member 147. This is accomplished by biasing the member 147 outwardly from the blind bore 148 by the means of the spring 155. The hexagonal socket 149 is provided with means for guiding the hexagonal ball 158 into socket 149. Such means is in the form of a conical opening 157 which acts as a guide to direct the hexagonal ball 158 on the end of the brake shaft 156 into the hexagonal opening 149. On assembly, if the hexagonal ball 158 is not properly aligned with the hexagonal socket 149, the socket member 147 will be pushed upward against the bias of spring 155 when the crusher head assembly 26 is positioned on the eccentric member 18. When the eccentric member 18 is rotated, the head assembly 26 will rotate with respect to the brake shaft 156 since the brake shaft 156 is held in position by the one way clutch 136. As soon as the hexagonal recess 149 aligns with the hexagonal ball 158, the spring force of spring 155 will push the socket member 147 downward against the ball 158 on brake shaft 156.

I claim:

1. A gyratory cone crusher comprising a main frame;

a bowl assembly supported by said main frame, a spindle positioned within said main frame; and an eccentric member having a first portion encircling said spindle and a second portion extending upwardly above said spindle;

first bearing means supporting said eccentric member on said frame for rotation relative to said spindle, said first bearing means including a radial roller bearing assembly located between the outer periphery of said first portion of said eccentric member and said frame, a crusher head assembly, second bearing means supporting said crusher head assembly on said eccentric member in a position to cooperate with said bowl assembly to crush material dropped into said bowl assembly, means for driving said eccentric member whereby a gyratory motion is produced between said crusher head assembly and said bowl assembly, an anti-spin means connected between said spindle and said crusher head assembly, said anti-spin means including a one-way clutch secured to said spindle and having a hexagonal socket, and a lock means secured to said crusher head assembly, and a brake shaft extending through the second portion of said eccentric member, and having a hexagonal ball at each end for releasedly engaging said hexagonal socket in said one-way clutch and said lock means, and a closed circuit oil flow path through said spindle and said eccentric member for circulating lubricating oil through said first and second bearing means.

2. The gyratory cone crusher according to claim 1 wherein said first bearing means is arranged to allow for the removal of the eccentric member from the spindle by lifting the eccentric member directly off the spindle.

3. The gyratory cone crusher according to claims 1 or 2 wherein said second bearing means is arranged to allow for the removal of the crusher head assembly from the eccentric member by lifting the crusher head assembly directly off the eccentric member.

4. The gyratory cone crusher according to claim 2 wherein said first bearing means includes an upper tapered thrust bearing assembly positioned between the top of the spindle and the eccentric member and a tapered radial bearing assembly positioned between the side of the spindle and the inside of said first portion of said eccentric member.

5. The crusher according to claim 4 wherein said second bearing means includes an upper tapered radial bearing assembly positioned between the second portion of said eccentric member and the inside of the crusher head assembly and a lower larger thrust and radial bearing assembly positioned between the first portion of said eccentric member and the inside of the skirt of said crusher head assembly.

6. The gyratory cone crusher according to claim 5 wherein said radial roller bearing assembly is positioned between the outside surface of the eccentric member and the frame includes a tapered roller bearing.

7. The cone crusher according to claim 1 wherein said lock means includes a socket member having a hexagonal socket mounted for axial movement in the crusher head assembly, said brake shaft including a hexagonal ball at one end for engaging the socket in said socket member.

8. The gyratory cone crusher according to claim 7 wherein said lock means includes a spring for biasing said socket member into engagement with said hexagonal ball on said brake shaft whereby said socket member will automatically seat on said brake shaft whenever relative rotation occurs between said crusher head assembly and said brake shaft.

9. A gyratory cone crusher comprising a frame, a conical bowl assembly supported on said frame and including an opening for receiving material to be crushed, a spindle projecting upwardly within the frame, an eccentric member having a first portion surrounding a portion of the spindle and a second portion extending upwardly from said spindle, first bearing means between the spindle and the eccentric member to enable the member to rotate with respect to the spindle about the axis of the first bearing means, means for rotating the eccentric member, a crusher head assembly positioned on the eccentric member, the crusher head assembly being located in a position to cooperate with said bowl assembly, second bearing means between the eccentric member to rotate within the crusher head assembly, the axis of the second bearing means being oblique to the axis of the first bearing means whereby the crusher head assembly will wobble as the eccentric member rotates, and anti-spin means connected between said spindle and said crusher head assembly to prevent rotation of said crusher head assembly with said eccentric member, said anti-spin means includes a lock assembly in said crusher head assembly, said lock assembly including a socket member having a hexagonal socket and a brake shaft having a hexagonal ball on one end for engaging said socket and including spring means for biasing said socket member into engagement with said hexagonal ball to lock said crusher head assembly to said drive shaft.

10. The gyratory cone crusher according to claim 9 wherein said first bearing means is arranged to allow for the direct removal of said eccentric member from said spindle.

11. The gyratory crusher according to claim 10 wherein said second bearing means includes two tapered rolling bearing assemblies being disposed to allow the lifting of the crusher head assembly off the eccentric member.

12. The gyratory cone crusher according to claim 9 including a lubricating oil flow path through said spindle and said eccentric member, means for pumping lube oil into the flow path in said spindle and first means between said spindle and said eccentric member for restricting the flow of oil to the first bearing means and second means between the eccentric member and the crusher head assembly for restricting the flow of oil to said second bearing means.

13. The gyratory cone crusher according to claim 12 wherein said first and second oil flow restricting means in combination with said eccentric member defines an oil reservoir and said anti-spin means is located within said reservoir.

14. The gyratory cone crusher according to claim 13 wherein said anti-spin means includes a one-way clutch secured to the upper end of said spindle, a lock assembly secured to said crusher head assembly and a brake shaft operatively connecting the one-way clutch to said lock assembly.

15. A gyratory cone crusher comprising:

a base including an upwardly presented shaft;

an eccentric member supported on said shaft and having a first portion surrounding said shaft and a second portion projecting above said shaft, a bearing carrier mounted in a normally fixed position with respect to the base and generally around the first portion of said eccentric member, first bearing means for enabling said first portion of said eccentric member to rotate relative to the base about an axis that is fixed in position with respect to the base and extends through the shaft, said first bearing means including a single row tapered roller bearing that surrounds said first portion of said eccentric member and is located between said eccentric member and the bearing carrier, means for rotating said eccentric member;

a crusher head positioned generally around said second portion of said eccentric member, said crusher head having an upwardly presented crushing surface;

second bearing means between said crusher head and said eccentric member for supporting said crusher head on said eccentric member and for enabling said eccentric member to rotate within said crusher head, said second bearing means including a first single row tapered roller bearing surrounding said first portion of said eccentric member, and a second single row tapered roller bearing surrounding said second portion of said eccentric member, the axis of said second bearing means being oblique to the fixed axis of said first bearing means, whereby said crusher head will wobble as said eccentric member rotates;

a housing extending over said crusher head, said housing having an inlet located above said crusher head so that material to be crushed may be directed through the inlet and toward said crusher head;

and a downwardly presented crushing surface located in a generally fixed position within said housing, the crushing surface of the housing being positioned opposite to, yet spaced from, the crushing surface on the head, so that material which is introduced into the housing through the inlet will be crushed in the space between the two crushing surfaces as said crusher head wobbles.

16. A crusher according to claim 15 wherein said first bearing means supports said eccentric member on said shaft and includes at least one roller bearing between said shaft and said eccentric member.

17. A gyratory cone crusher comprising:

a base, a fixed member projecting upwardly from said base and being fixed in position with respect to the base, an intermediate member having a first portion surrounding said fixed member, and a second portion extending upwardly from said first portion, first bearing means for enabling said intermediate member to rotate with respect to the fixed member about the axis of the first bearing means, said first bearing means including a thrust bearing and a radial bearing surrounding said fixed member so as to transfer radial and thrust loads from the intermediate member to the fixed member and base; means for rotating said intermediate member, a crusher head mounted on said intermediate member and having a first inner portion surrounding said first portion of said intermediate member, said crusher head having an upwardly presented crushing surface;

second bearing means between said crusher head and said intermediate member to enable said intermediate member to rotate within said crusher head, said second bearing means including a first single row tapered roller bearing surrounding said first portion of said intermediate member, and a second single row tapered roller bearing surrounding said second portion of said intermediate member, the axis of the second bearing means being oblique to the axis of said first bearing means, whereby the head will wobble as the intermediate member rotates;

a housing extending over said crusher head, said housing having an inlet located above said crusher head so that material to be crushed may be directed through said inlet and toward the head and a downwardly presented crushing surface positioned within said housing, the crushing surface of said housing being positioned opposite to, yet spaced from, the crushing surface on said head, so that material introduced into the housing through the opening will be crushed in the space between the two crushing surfaces as said crusher head wobbles.

18. The crusher according to claim 17 wherein said first portion of said intermediate member comprises a skirt that surrounds said fixed member and said second portion of said intermediate member comprises a stub shaft projecting upwardly from said skirt and being smaller in diameter than said skirt.

a base, a fixed member projecting upwardly from said base and being fixed in position with respect to the base, an intermediate member having a first portion surrounding said fixed member and a second portion extending upwardly from said first portion, first bearing means for enabling said intermediate member to rotate with respect to the fixed member about the axis of the first bearing means, said first bearing means including a thrust bearing and a radial bearing surrounding said fixed member so as to transfer radial and thrust loads from the intermediate member to the fixed member and base; means for rotating said intermediate member, a crusher head mounted on said intermediate member and having a first inner portion surrounding said first portion of said intermediate member, said crusher head having an upwardly presented crushing surface;

second bearing means between said crusher head and said intermediate member to enable said intermediate member to rotate within said crusher head, the axis of the second bearing means being oblique to the axis of said first bearing means, whereby the head will wobble as the intermediate member rotates;

a housing extending over said crusher head, said housing having an inlet located above said crusher head so that material to be crushed may be directed through said inlet and toward the head and a downwardly presented crushing surface positioned within said housing, the crushing surface of said housing being positioned opposite to, yet spaced from, the crushing surface on said head, so that material introduced into the housing through the opening will be crushed in the space between the two crushing surfaces as said crusher head wobbles.

19. The crusher according to claim 18 wherein the diameter of the first portion of the intermediate member is greater than the diameter of the second portion of the intermediate member.

20. A gyratory crusher comprising:

a base;

a shaft fixed firmly to and projecting upwardly from the base;

an eccentric member having a skirt extending over and surround said shaft and a stub shaft projecting upwardly from said skirt and overlying said shaft;

a bearing carrier normally fixed in position with respect to the base and surround said skirt, a first roller bearing between the side of the shaft and the inside of said skirt to take radial loading applied to said eccentric member, a second roller bearing surrounding said skirt and located between the said skirt and the bearing carrier, the second bearing having its axis common with the axis of said first bearing, whereby said first and second bearings enable the eccentric member to rotate on the fixed shaft about the axis of the bearings;

means for rotating the eccentric member;

a crusher head extended around and over a portion of said eccentric member and having a generally conical upwardly presented surface;

second bearing means between said eccentric member and said crusher head to enable said eccentric member to rotate relative to said crusher head, said second bearing means including a first tapered roller bearing surrounding said skirt, and a second tapered roller bearing surround said stub shaft, said tapered rollers being located within said crusher head and having their big ends presented downwardly and outwardly from the axis of rotation of said crusher head, the axis of said second bearing means being inclined slightly with respect to the common axis of said first and second bearings, whereby said crusher head will wobble as the eccentric member revolves within it;

a housing enclosing said crusher head and having an inlet opening located generally over said crusher head; and a generally conical crushing surface located within the housing so as to be over and spaced from the conical crushing surface on the head, the crushing surface of the housing being generally fixed in position with respect to the base, whereby as said crusher head wobbles the space between it and any point on the crushing surface of the housing will alternately enlarge and contract so that material within the space will be crushed.

a base;

a bearing carrier normally fixed in position with respect to the base and surrounding said skirt, a first roller bearing between the side of the shaft and the inside of said skirt to take radial loading applied to said eccentric member,

* * * * *

UNITED STATES PATENT AND TRADEMARK OFFICE

CERTIFICATE OF CORRECTION

PATENT NO. : 4,467,971

DATED : August 28, 1984

INVENTOR(S) : LeRoy Schuman

It is certified that error appears in the above—identified patent and that said Letters Patent is hereby corrected as shown below:

Column 12, Line 11: After the word "wobbles", insert ---in---.

Signed and Sealed this

*Twelfth* Day of *February 1985*

[SEAL]

*Attest:*

DONALD J. QUIGG

*Attesting Officer* *Acting Commissioner of Patents and Trademarks*